United States Patent [19]

Goldman et al.

[11] 4,157,829

[45] Jun. 12, 1979

[54] INSTANT LOTTERY GAME EMPLOYING VENDING MACHINES WHICH ARE CENTRALLY CONTROLLED BY COMPUTERS

[75] Inventors: Max Goldman; Carl Alexoff, both of Cherry Hill, N.J.

[73] Assignee: System Operations, Inc., Princeton, N.J.

[21] Appl. No.: 734,964

[22] Filed: Oct. 22, 1976

Related U.S. Application Data

[63] Continuation of Ser. No. 544,923, Jan. 28, 1975, abandoned.

[51] Int. Cl.[2] ..... A63F 9/00

[52] U.S. Cl. ..... 273/138 A

[58] Field of Search ..... 273/1 E, 138 A, 139; 340/172.5; 445/1; 364/200 MS File, 900 MS File

[56] References Cited

U.S. PATENT DOCUMENTS

| | | | |
|---|---|---|---|
| 3,688,276 | 8/1972 | Quinn | 445/1 |
| 3,770,269 | 11/1973 | Elder | 273/1 E |
| 3,786,234 | 1/1974 | Trent et al. | 273/138 A X |
| 3,825,255 | 7/1974 | Kennard et al. | 273/1 E |
| 3,876,208 | 4/1975 | Wachtler et al. | 273/1 E X |
| 3,909,002 | 9/1975 | Levy | 273/138 A |

*Primary Examiner*—Vance Y. Hum

*Attorney, Agent, or Firm*—Ostrolenk, Faber, Gerb & Soffen

[57] ABSTRACT

An instant lottery game in which remote vending machines are centrally controlled by a central computer is disclosed. Each vending machine generates a pre-selected indicia which may be player-controlled. Upon the receipt of a wager of a proper amount, the central computer generates a random indicia. The number of matches between the random and pre-selected indicia are determined and the prize amount based upon the number of matches and the wager amount is computed. The vending machine immediately pays out the prize amount if it is less than a pre-determined value and issues a validation ticket if the prize amount is more than said pre-determined value.

14 Claims, 5 Drawing Figures

INSTANT LOTTERY GAME EMPLOYING VENDING MACHINES WHICH ARE CENTRALLY CONTROLLED BY COMPUTERS

RELATED INVENTIONS

This is a continuation of application Ser. No. 544,923, filed Jan. 28, 1975, now abandoned.

BACKGROUND OF THE INVENTION

The present invention relates to games and contests and more particularly to a novel method and apparatus for playing an instant lottery game employing remote vending machines which are controlled by a central computer.

There presently exists a large variety of games and other contests in which individuals may participate in the hope of winning a prize. Typical of these contests are lotteries or other games, many of which are administered by various governmental agencies. In a popular type of lottery, the game is conducted in a manner such that the operating agency prints a large number of tickets, each bearing one or more number symbols or other indicia, unique to that ticket, a group of tickets being printed and designated for a particular game having a fixed closing date. Holders of all tickets dispensed before the closing date are then eligible for a prize with the winning numbers being publicly announced after a drawing which is conducted shortly after the closing date. This type of lottery game suffers from many administrative problems, i.e. all tickets which the agency desires to dispense prior to the cut-off date must be printed and distributed to authorized representatives for dispensing purposes with sufficient time to allow the largest number of participants to obtain tickets prior to the cut-off date; all tickets are dated and are allocated to a particular drawing; any tickets not dispensed by the cut-off date cannot be used for any subsequent drawings; and these undispensed tickets must be accounted for to insure absolute honesty of the game.

Most important, from a player acceptance viewpoint, this type of lottery does not enable each participant to immediately ascertain whether he has a winning ticket or to select his own indicia.

To provide for player selection, games have been devised in which a player may select his own indicia, or combination thereof, such systems being typically referred to as a pick-your-own (PYO) system. In a typical PYO system, players make their selections upon a marksense card. The representative dispenses the card, accepts the required amount of money from the player and employs apparatus to validate the player's completed card. Each card is usually of the form having an original and a duplicate copy, with the representative retaining a copy and dispensing the original to the participant as an authenticated receipt.

After the closing date of each game, a representative of each administrating agency visits each agent, obtains data as to the initial and final serial numbers imprinted by the validation apparatus, resets and seals the validation apparatus for the next game cycle and receives all authenticated duplicate cards from the agent. The representative then takes all this information to a central location, where the duplicate cards are fed into a marksense and character scanner which reads the information thereon and inputs the necessary information into a computer peripheral (tape or deck) or directly into a computer. After the results have been determined, the computer automatically lists all winning tickets by agent and by serial number and determines the size of each prize won by calculating and dividing up the prize pools.

One of the disadvantages of such a system lies in the fact that there is an appreciable time interval between a player's purchase of a ticket and the selection of the winning ticket. The operating agency is at a disadvantage in that the cost of hiring representatives to visit each agent at the end of each game to collect the information and return it to a central location is often prohibitive and diminishes the profit to be used for public benefit. Further, the operating agency must continually monitor its imprinting devices to maintain security.

BRIEF DESCRIPTION OF THE INVENTION

The present invention is characterized by providing a novel method and apparatus for administering an instant lottery game employing multiple remote vending machines which are centrally controlled by a single computer, which instant lottery eliminates the above-mentioned disadvantages.

The instant lottery system uses vending machines which are connected by a communication line to a central computer facility. Each vending machine accepts a wager of at least one of a number of denominations. A player first inserts his selection using a dial control on the vending machine, which selection can consist of a number, symbol or other indicia or a series of such indicia. The player either inserts the required wager amount directly into the vending machine or tenders this amount to an agent, who resets the machine for each play. Insertion of the money, or of a token, causes a message including the vending machine number and the player's selection to be sent to a central computer to initiate a selection of a random indicia sequence. There are many methods by which a computer can select a random indicia sequence. In one approach, where the indicia are single digit numbers, 0 to 9, the computer contains a high speed clock which splits a second into microseconds in a clock register; at the time the message is received, the clock register contains a number to six decimal places, which number is employed as the random indicia sequence. The computer generates a return message which includes a sequential number and the then selected random indicia sequence and also determines if a match has occured between the player's selection and the random indicia for that play. If such match has occurred, the computer determines the amount won based on the number of matches. The message is accepted by the vending machine to sequentially display the random indicia and the amount won, if a proper match exists. For small winning payouts, the coins or tokens are immediately returned to the player and for larger payouts a ticket is printed by the device which shows the player's selection, the random indicia, the serial number, the amount wagered and the amount won. The player then presents the ticket to a claims center where a prize validation terminal is utilized to interrogate the central computer and validate the player's ticket and the amount of payment the player is to receive.

In other embodiments of the instant lottery game, the central computer also randomly selects the single or multiple indicia to be matched or on indicia is selected to be matched and a prize is awarded according to the number of times a single indicia appears in the random indicia sequence.

It is therefore one object of the present invention to provide a novel method and apparatus for administering a lottery game providing instant results.

Another object of the present invention is to provide such method and apparatus utilizing remote vending machines which are centrally controlled by a single computer facility.

These as well as other objects of the present invention will become apparent when reading the accompanying description and drawings.

DETAILED DESCRIPTION OF THE INVENTION

Figure 1:
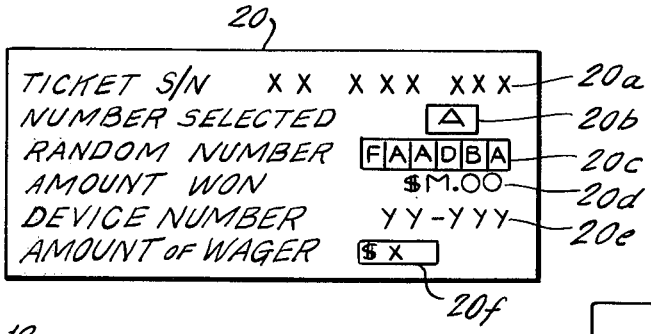
FIG. 1 is a plan view of a winning ticket in accordance with the principles of the present invention.
Figure 2:
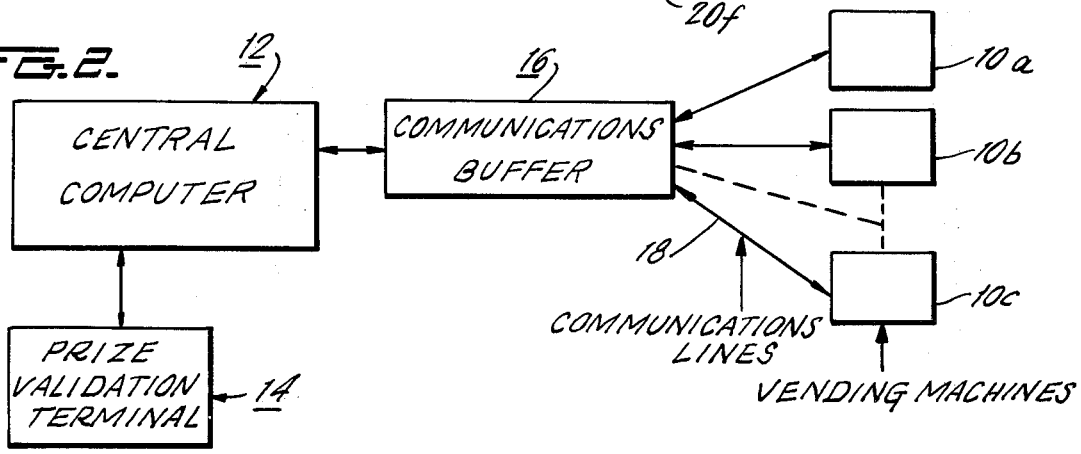
FIG. 2 is a block diagram illustrating apparatus in accordance with the principles of the present invention.
Figure 3:
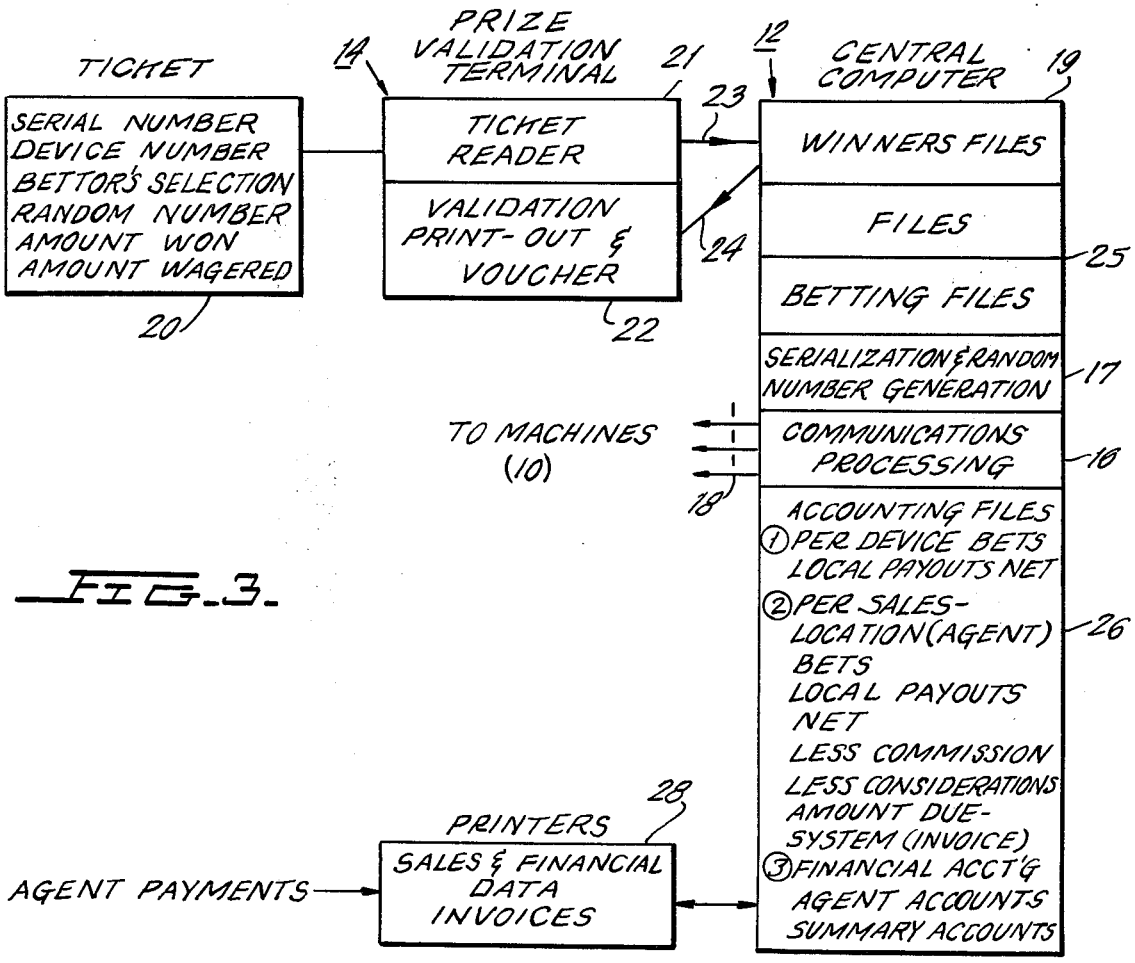
FIG. 3 is a detailed block diagram further illustrating individual mechanism functions in accordance with the principles of the present invention.

Referring to all of the drawings, an instant lottery game utilizes a plurality of remote vending machines 10, a central computer 12, and a prize validation terminal 14. The central computer includes a communications buffer 16, whose use will be described hereinafter in greater detail, to interconnect with each of the vending machines 10 via one of a plurality of communications lines 18.

In a preferred instant lottery game, a player approaches one of the vending machines 10 and adjusts appropriate dial controls to select his desired number, symbol or other indicia thereon. It should be understood that while the following description of the invention is given with reference to a single selected number, the instant lottery game of the present invention may utilize one, or a combination of several, of a group of selected numbers, symbols or other indicia in replacement thereof. After the player has selected his number, money or a token is inserted into an appropriate aperture in vending machine 10. Alternatively, a sales agent may receive the money and either issue tokens for use in a vending type machine or simply cause the machine to be reset and made ready for the next play. A preferred instant lottery system, requiring no intervention by a sales agent, utilizes sales-type devices into which coins or paper money are directly inserted until one of a plurality of selectable wager amounts has been received.

Upon receipt of the player's selected number and the amount of a selected wager, the machine 10 causes an activation signal to be electrically transmitted over the associated one of communications lines 18 to communications buffer 16. Central computer 12 includes a random number generator 17, such as a clock generator and storage register arrangement for dividing each second of time into a microsecond time equivalent. Communications buffer 16 receives the activation signal and thereupon interrogates central computer 12 for a six digit random number sequence as generated in the register at that instant. The random number is transferred to communications buffer 16 for transmittal of the six-digit random lottery number to that device which activated computer 12. Additionally, central computer 12 includes comparison and storage means 19 to compare the player-selected number with each of the six random digits and determine the number of matches therebetween. The number of matches, if any, and the amount of the wager made enable central computer 12 to determine the prize amount. Memory means 19 stores information as to any winning game. This information may include the amount wagered, the amount won, the number selected, the random generated number and the playing device serial number. Communications buffer 16 receives the six-digit random number; the amount won, if any, and a sequential serial number which relates the random number to the transaction and transmits this data via communications line 18 to the originating machine 10 which displays the random number and the amount won to the player. The display portion of machine 10 may be buffered and timed by the computer 12 via communications buffer 16 so that each random number or indicia is displayed in sequence to add interest and excitement to the game. Alternatively, machine 10 may internally buffer and time the random indicia received from computer 12.

For small prize amounts, coins or tokens are immediately returned to the player by machine 10. For larger prizes, machine 10 prints a ticket 20 which ticket includes areas in which are indicated the ticket serial number 20*a*, the player's selected indicia 20*b*, the random indicia 20*c* generated by the computer, the amount won 20*d*, the device number 20*e* and the amount wagered 20*f*. The player presents ticket 20 at some later time to a lottery game claims center to claim his prize and receive his payment.

At the claims center, a winning ticket 20 is inserted into a prize validation terminal 14, which contains a ticket reader 21 and a validation printout and voucher device 22. Ticket 20 is read by ticket reader 21 and the data is transmitted by line 23 to central computer 12 to be checked against the information previously stored in the winners files 19. When the ticket information is verified against that information stored in the winners files 19 at the time of random indicia generation, data is transmitted by line 24 to the validation printout and voucher section 22, of prize validation terminal 14, to enable the player to receive his prize money. The central computer 12 is programmed to carry out all clerical systems requirements including the maintaining of: winners files 19; files 25 concerning all bets placed and their amount and frequency; game serialization and random indicia generation 17; communications processing and/or buffering 16; and all required general accounting 26. For this last function, the central computer 12 interfaces with one or more printers 28 to receive sales and financial data invoices and information of payments by agents.

To illustrate one specific instant lottery game of many which may be played using the method and apparatus just described, a central computer 12 having a communications buffer 16 is coupled to several hundreds of vending machines such as 10*a*, 10*b*, 10*c*, etc. via communications lines 18. Each vending machine 10 contains a selection control, by which control a single number or symbol may be selected.

After player selection, the number 20*b* is electronically displayed at the front panel of vending machine 10. The player inserts the required denominations of coins and the vending device transmits an actuation signal along one of communications lines 18, through communications buffer 16 to the central computer 12. The computer contains a random number generator, such as a high speed clock and register to split a second into microseconds. At the instant of time when the actuation signal is received by buffer 16, the clock register of the random number generator 17 contains a six decimal place time representation, which 6 digit number is used as the random lottery number 20*c*. Computer 12 compares the player selection number 20*b* against each digit of the random number to determine the number of matches and the amount won 20*d*. The winning information is transmitted via communications buffer 16 along the same one of communications lines 18 to the originating machine 10. Computer 12 stores the random number 20*c*, the player's selected number 20*b*, a serial number 20*a* representing the game transaction, the device number 20*e* and any other desired winning information in the winners files portion 19 of its memory bank. The message is received at vending machine 10 and the random number and amount won are sequentially displayed.

One example of an instant lottery game prize structure, based on the number of digits in the random number which match the selected number in the above-illustrated game, is:

TABLE I

| No. of Matches | No. Per Million Plays | PRIZES Per Amount Wagered $1 Wager | 50¢ Wager | 25¢ Wager | 10¢ Wager |
|---|---|---|---|---|---|
| 2* | 98,415 | $2 | $1.00 | 50¢ | 20¢ |
| 3* | 14,580 | $5 | $2.50 | $1.25 | 50¢ |
| 4 | 1,215 | $50 | $25 | $12.50 | $5 |
| 5 | 54 | $1,000 | $500 | $250 | $100 |
| 6 | 1 | $100,000 | $50,000 | $25,000 | $10,000 |

where the prizes for two or three matched numbers (*) are immediately returned to the player and a ticket 20 is printed for a 4, 5 or 6 matched-number prize.

Thus it is seen that, for a wager in the amount of $1.00, the following examples of prize returns result:

TABLE II

| Player selection | Random Number | Matches | Prize |
|---|---|---|---|
| 6 | 186036 | 2 | $2 |
| 4 | 474492 | 3 | 5 |
| 0 | 010060 | 4 | 50 |
| 7 | 717777 | 5 | 1,000 |
| 8 | 888888 | 6 | 100,000 |

It may be assumed that the small prizes which are immediately returned by vending machine 10, as shown in Tables I and II, will be immediately replayed by the lottery game player. In this case, for every one million lottery games played, the total amount returned to the players has been calculated to be:

TABLE III

| No. of Matches | Frequency Per Million Plays | × Prize | = Amount Returned |
|---|---|---|---|
| 3 | 14,580 | 5 | $ 72,900 |
| 4 | 1,215 | 50 | $ 60,750 |
| 5 | 54 | 1,000 | $ 54,000 |
| 6 | 1 | 100,000 | $100,000 |
| | Total Amount Returned | | $307,650 |

Therefore, when a match of a player selected digit to only two of the six random digits returns a prize of $2.00 which is replayed immediately, the prize payout percentage is $307,650 divided by $803,170, or 38.3%.

If the $5.00 triple number match prizes are also replayed, the prize payout will be:

TABLE IV

| No. of Matches | Frequency Per Million Plays | × Prize | = Amount Returned |
|---|---|---|---|
| 4 | 1,215 | 50 | $ 60,750 |
| 5 | 54 | 1,000 | $ 54,000 |
| 6 | 1 | 100,000 | $100,000 |
| | Total Amount Returned | | $214,750 |

For one million games played, a total of $730,270 ($1,000,000 original wagers—$196,830 double matches replayed—$72,900 triple matches replayed) will be received and the total payout percentage is $14,750 divided by $730,270, or 29.4%.

On the average, for every one hundred plays, 29 additional free plays will be received.

Having a lottery game with more than 3 matches, the player receives his winning ticket 20 from machine 10 and is instructed to immediately place his name on the back of the ticket in ink. Ticket 20 is preferably printed on non-erasable paper, so that no other person can illegally claim the prize. Additionally, prize ticket 20 may be validated at the time and place of issuance by an agent of the game operator where a vending machine, operating on tokens or being reset by the agent, is employed. Validation stamps may be used, as described in U.S. patent application Ser. No. 432,904, filed Jan. 14, 1974, now abandoned and assigned to the assignee of the present invention.

In other preferred embodiments of the instant lottery game, the player has no control over the selection of the indicia to be matched. This indicia may also be randomly generated in computer 12, with the random indicia sequence 20*c* and the random selected indicia 20*b* to be matched, both being transmitted via buffer 16 and communications line 18 to the activating vending machine 10—or the indicia 20*b* to be matched may not be used, whereupon a prize is won according to the number of times any one indicia appears in the random indicia sequence.

To illustrate a sample instant lottery game, utilizing the method and apparatus of the invention, without a player or computer selection of an indicia 20*b* to be matched, computer 12 is activated by the insertion of a wager of proper amount at vending machine 10, as previously described. Random indicia sequence generator 17 outputs a sequence, such as a six digit random number, in response to the activation signal. The indicia, or numbers, in all positions of the sequence are compared and a prize awarded according to the number of times a number or indicia appears in the sequence. A special prize may be awarded if one special number appears in all indicia positions. Thus, in a sample prize structure for such a No-Selection game, using six random digits:

TABLE V

| Combination | No. Per Million Plays | Prize (per $1 Wager) | Total |
|---|---|---|---|
| 6 - 7s | 1 | $100,000 | $100,000 |
| 6 of a kind | 9 | $ 5,000 | $ 45,000 |
| 5 of a kind | 540 | $ 100 | $ 54,000 |
| *4 of a kind | 12,150 | $ 10 | $121,500 |
| *3 of a kind | 145,800 | $ 2 | $291,600 |
| | Total Amount Returned | | $612,000 |

Where the prizes for 3 or 4 of a kind (*) are immediately returned to the player and a ticket 20 is printed for a 5 or 6-of-a-kind or 6 -7s match prize. As previously discussed, the returned prizes may be replayed, so that the amount returned will become:

TABLE VI

| No. of Matches | Frequency per Million Plays × Prize | = Amount Returned |
|---|---|---|
| 6 - 7s | 1 $100,000 | = $100,000 |
| 6 of a kind | 9 $ 5,000 | = $ 45,000 |
| 5 of a kind | 540 $ 100 | = $ 54,000 |
| | Total Amount Returned | = $199,000 |

For one million games played, a total of $587,900 ($1,000,000 original wagers—$121,500 four of a kind matches repaid—$291,600 three of a kind matches repaid) will be received and the total payout percentage is $199,000 divided by $587,900 or 33.9%.

For every 1000 plays, an average of 413 free plays are received.

Lottery system security is obtained through the use of known vending machine construction techniques to prevent illegal entry and by use of known electronic security devices to prevent illegal access and control of the communications lines 18 between communications buffer 16 and any one individual machine 10. Additional security is unnecessary as serial presentation of each vending device actuation signal to the central computer 12 via the communications buffer 16, in a time shared configuration, renders impossible the ascertainment by a lottery player of the exact random number to be generated when his wager causes the generation of a particular random number in central computer 12.

There has just been described a novel method and apparatus for administering a lottery game providing instant results and utilizing vending machines which are centrally controlled by a remote computer.

Figure 4:
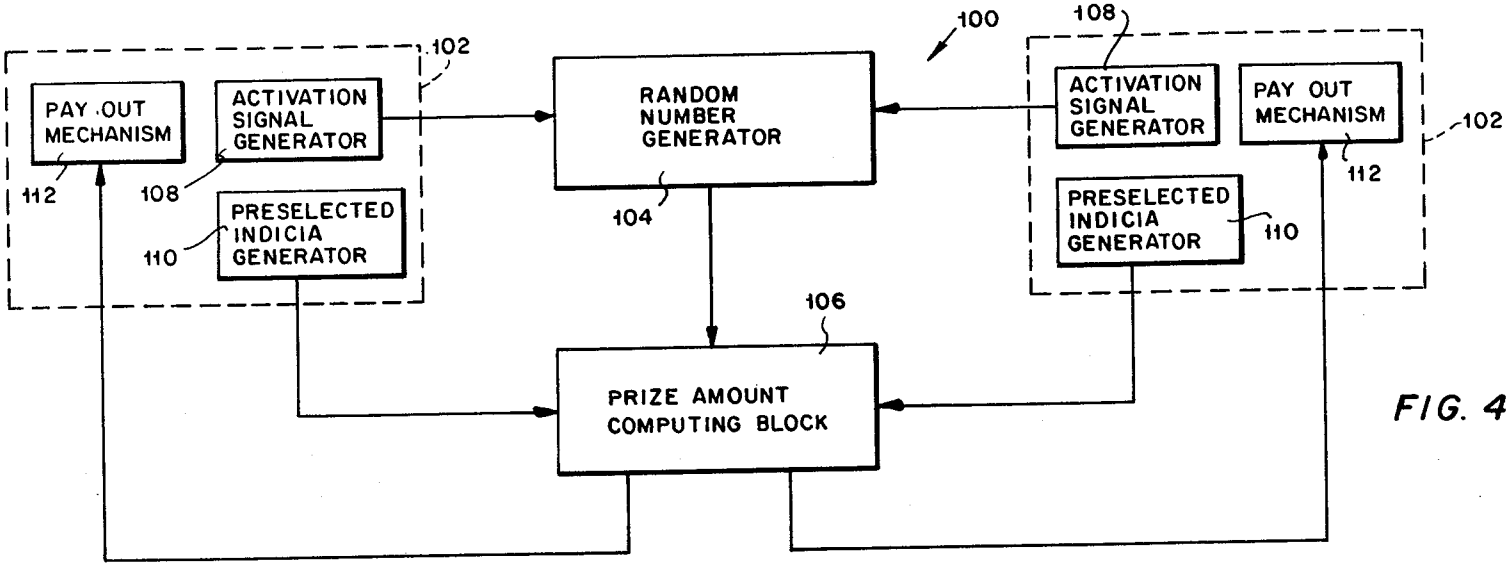
FIG. 4 is a block diagram of an instant lottery game constructed in accordance with the principles of the present invention.

FIG. 4 is block diagram of an apparatus for conducting an instant lottery game in accordance with the principles of the present invention. Instant lottery game 100 includes a plurality of remote vending machines 102, a random number generator 104, and a prize amount computing block 106. Each of the remote vending machines 102 includes an activation signal generator 108, a preselected indicia generator 110 and a pay-out mechanism 112. The activation signal generator 108 generates an activation signal upon receipt of a wager of a proper amount and applies the activation signal to the random number generator 104. Upon receipt of the activation signal, the random number generator 104 generates a sequence of random indicia and applies the sequence to the prize amount computing block 106. The random indicia generated by random number generator 104 is compared to a preselected indicia generated by preselected indicia generator 110 in prize amount computing block. The prize amount computing block determines the number of matches between the preselected indicia and the random indicia and computes the prize amount based upon the number of matches and the wager amount. The prize amount is applied to the pay-out mechanism 112 which immediately pays out the prize amount if it is less than the predetermined value and which issues a validation ticket entitling the player to collect the prize amount at a validation center if the prize amount is greater than the predetermined value.

Figure 5:
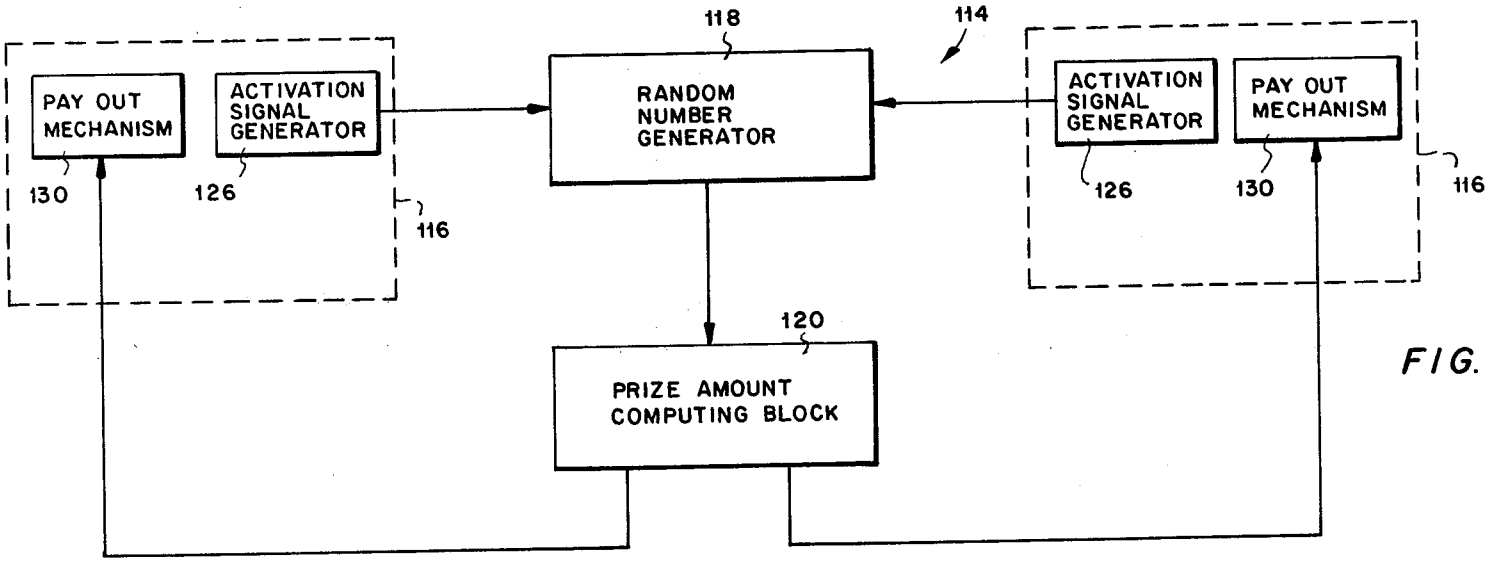
FIG. 5 is a block diagram of yet another instant lottery game constructed in accordance with the principles of the present invention.

FIG. 5 is a block diagram of a second apparatus for conducting the instant lotter game of the present invention. Instant lottery game 114 includes a plurality of remote units 116, a random number generator 118 and a prize amount computing block 120. Each of the remote vending machines includes an activation signal generator 126 and a pay-out mechanism 150. Activation signal generator 126 generates an activation signal upon receipt of a wager of a proper amount and applies the activation signal to random number generator 118. Upon receipt of the activation signal, random number generator 118 generates a sequence of random indicia and applies this sequence to prize amount computing block 120. Prize amount computing block 120 determines the number of matches between individual elements of the random indicia and computes a prize amount based upon the number of matches and the wager amount. The prize amount computed by block 120 is applied to pay-out mechanism 130. The pay-out mechanism 130 immediately pays out the total prize amount if it is less than the predetermined value and issues a validation ticket entitling the player to collect the prize amount at a validation center if the total prize amount is greater than the predetermined value.

The present invention has been described in connection with a preferred embodiment thereof, and many variations and modifications will become apparent to one skilled in the art. It is preferred therefore, that the present invention be limited not by the specific disclosure herein, but only by the appended claims.

What is claimed is:

1. Apparatus for conducting an instant lottery game, comprising:

(A) first means for generating a sequence of random indicia responsive to an activation signal;

(B) a plurality of remote vending machines, each said vending machine including:

(1) second means for generating an activation signal upon receipt of a wager of a proper amount, said activation signal being applied to said first means so as to initiate generation of said random indicia;

(2) third means for generating a pre-selected indicia;

(C) fourth means for determining the number of matches between said pre-selected indicia and said random indicia and for computing a prize amount based upon said number of matches and the wager amount; and (D) each said remote vending machine also including fifth means for immediately paying the prize amount if it is less than a pre-determined value and for issuing a validation ticket entitling the player to collect the prize amount at a validation center if the prize amount is greater than said pre-determined value.

2. The apparatus of claim 1 wherein said fifth means includes means for printing on said ticket a vending machine identification number, said pre-selected indicia, said random indicia and the prize amount won.

3. The apparatus of claim 2 wherein each said vending machine includes sixth means for displaying said pre-selected indicia, said random indicia, the number of matches and the prize amount.

4. The apparatus of claim 3 wherein said third means is player adjustable such that the player may select the pre-selected indicia.

5. Apparatus for conducting an instant lottery game comprising:

(A) first means for generating a sequence of random indicia responsive to an activation signal;

(B) a plurality of remote vending machines, each said remote vending machine including second means for generating an activation signal upon receipt of a wager of a proper amount, said activation signal being applied to said first means so as to initiate generation of said random indicia;

(C) third means for determining whether there are matches between individual elements of said random indicia and for computing a prize amount based upon the number of matches and the wager amount; and (D) each remote vending machine including fourth means for immediately paying out said prize amount if it is less than a pre-determined value and for issuing a validation ticket entitling the player to collect said prize at a validation center if said prize amount is greater than said pre-determined value.

6. The apparatus of claim 5 wherein said fourth means includes means for printing on said ticket a vending machine identification number, the random indicia and said prize amount.

7. The apparatus of claim 6 wherein each said vending machine includes fifth means for displaying said random indicia, the number of matches and said prize amount.

8. A method for conducting an instant lottery game, comprising the steps of:

providing a plurality of remote vending machines;

generating an activation signal at said remote vending machine whenever said remote vending machine receives a wager of a proper amount;

generating a sequence of random indicia responsive to the generation of said activation signal;

generating at each of said vending machines a pre-selected indicia associated with that vending machine;

determining the number of matches between said pre-selected indicia and said random indicia;

computing a prize amount based upon said number of matches and said wager amount;

paying the prize amount if it is less than a pre-determined value and issuing a validation ticket entitling the player to collect the prize amount at a validation center if the prize amount is greater than said pre-determined value.

9. The method of claim 8 wherein said step of issuing a validation ticket includes the step of printing on said ticket a vending machine identification number, the pre-selected indicia, the random indicia and the prize amount won.

10. The method of claim 9 further including the step of displaying at the vending machine having received the wager of a proper amount the pre-selected indicia, the random indicia, the number of matches and the prize amount.

11. The method of claim 10 further including the step of adjusting the pre-selected indicia to a desired sequence.

12. A method for conducting an instant lottery game comprising the steps of:

providing a plurality of remote vending machines;

generating an activation signal upon receipt of a wager of a proper amount by any said vending machine;

determining whether there are matches between individual elements of said random indicia and computing a prize amount based upon the number of matches of said individual elements and the wager amount; and paying out said prize amount at the remote vending machine having received a wager of the proper amount if said prize amount is less than a predetermined value and issuing a validation ticket at the vending machine having received the wager of the proper amount if said prize amount is greater than the predetermined value.

13. The method of claim 12 wherein said steps of issuing a validation ticket includes the step of printing on said ticket a vending machine identification number, said random indicia and said prize amount.

14. The method of claim 13 further including the step of displaying at said vending machine having received a wager of the proper amount said random indicia, the number of matches and said amount.

* * * * *